US007637546B2

(12) United States Patent
Navarre, II

(10) Patent No.: US 7,637,546 B2
(45) Date of Patent: Dec. 29, 2009

(54) APPARATUS FOR MOVING TUBULARS AND METHOD OF USING SAME

(76) Inventor: Carbert Wade Navarre, II, 632 E. Broussard Rd., Lafayette, LA (US) 70503

( * ) Notice: Subject to any disclaimer, the term of this patent is extended or adjusted under 35 U.S.C. 154(b) by 46 days.

(21) Appl. No.: 11/656,308

(22) Filed: Jan. 19, 2007

(65) Prior Publication Data

US 2008/0173848 A1 Jul. 24, 2008

(51) Int. Cl.
*B65G 7/10* (2006.01)
*B65G 7/04* (2006.01)

(52) U.S. Cl. ..... 294/15; 294/4

(58) Field of Classification Search ..... 294/4, 294/15; 254/105; 16/430
See application file for complete search history.

(56) References Cited

U.S. PATENT DOCUMENTS 473,630 A * 4/1892 Leffingwell ..... 294/4
2,444,353 A * 6/1948 Kimmey ..... 294/4
3,436,110 A * 4/1969 Kahlor ..... 294/15
4,893,860 A * 1/1990 Kurbanov et al. ..... 294/91
5,234,240 A * 8/1993 Richard ..... 294/15
5,979,840 A * 11/1999 Hollister et al. ..... 294/15
2004/0124404 A1 * 7/2004 Goldie ..... 254/94

* cited by examiner

*Primary Examiner*—Paul T Chin
(74) *Attorney, Agent, or Firm*—Matthews, Lawson & Bowick PLLC

(57) ABSTRACT

A channel member having four roller wheels is controlled by an ergonomic handle formed from a continuous length of aluminum tubing having a first arm to support one hand of a user, and a second arm to support a second hand of the user to guide and stabilize the handle, and to accept the weight of the user, when the roller wheels are pushed against an oilfield tubular, thus causing the oilfield tubular to be rolled from one position to another.

7 Claims, 3 Drawing Sheets

APPARATUS FOR MOVING TUBULARS AND METHOD OF USING SAME

BACKGROUND OF INVENTION

Oilfield operations commonly use oilfield tubulars in such operations, for example, drill pipe, casing, workover tubing and production tubing, all in various diameter sizes. These different tubulars come in different lengths, but may typically each be 18-20 feet long. These various tubulars use various grades of metal, typically manufactured from steel or steel alloys, and will have different weights depending on some or all of these variables.

Although some of these tubulars, such as large diameter steel casing, may weigh several thousand pounds, and can not be easily moved around by hand, if at all, many such tubulars can be moved by rolling them along the ground level, or along the rig floor, or along a floor adjacent a pipe rack.

Rolling a tubular is, of course, easier than sliding the tubular, because rolling friction is less than sliding friction.

It should be appreciated that, although the invention contemplates the use of the invention for the rolling of oilfield tubulars, the invention also contemplates the rolling of other pipe, including but not being limited to pipe used for moving water, gas, chemicals, or the like, and also contemplates solid pipe having no central bore.

DETAILED DESCRIPTION OF THE DRAWINGS

Figure 1:
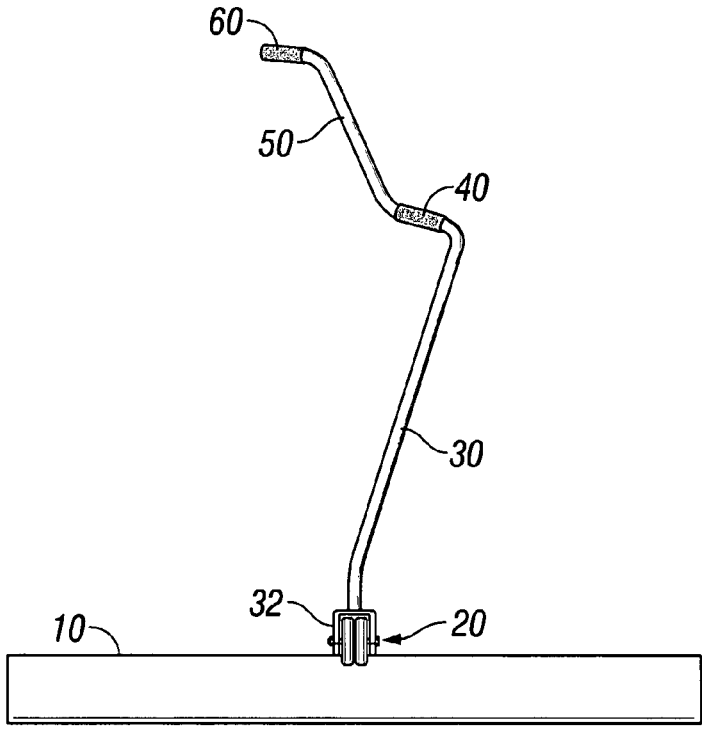
FIG. 1 is an elevated, pictorial, front view of the apparatus according to the invention being used to roll a tubular.
Figure 6:
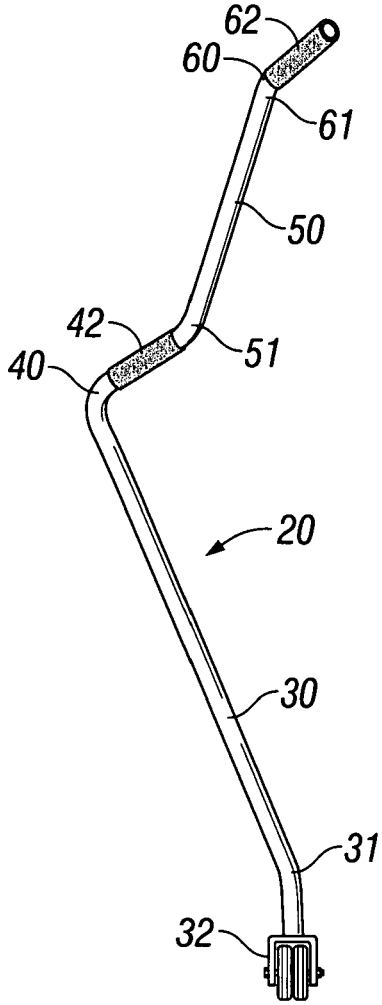
FIG. 6 is an elevated, diagramatic view of the apparatus according to the invention.

Referring now to the drawings in more detail, especially to FIG. 1, there is illustrated a length of conventional pipe 10. The pipe 10 may be an oilfield tubular, or may be any type of pipe discussed herein above. The apparatus 20, described in greater detail in FIG. 6, is illustrated as having its rollers pressed against the external surface of the tubular 10 to allow the tubular 10 to be rolled along as desired. The apparatus 20 has an ergonomic handle having a first arm 30 and a second arm 40 angled from the first arm 30 at any desired angle, for example, at about 90°.

A third arm 50 is angled away from the second arm 40, at any desired angle, for example, at about 45°. An arm 60 is angled from the arm 50, at any desired angle, for example, at about 45°. The arm 60 and the arm 40 contemplate being used to guide, or otherwise stabilize the handle 20, and also contemplate receiving some weight of the user to apply weight to the rollers against the tubular 10. As an optional feature, the arms 60 and 40 have non-slip hand grips 62 and 42, respectively, to allow the user to use both hands and thus control the apparatus accordingly to the invention and thereby cause the tubular 10 to be rolled along.

Figure 3:
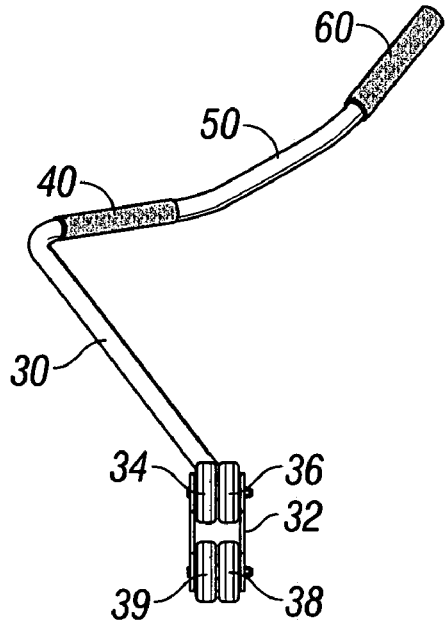
FIG. 3 is an elevated, pictorial, bottom view of the apparatus according to the invention.
Figure 4:
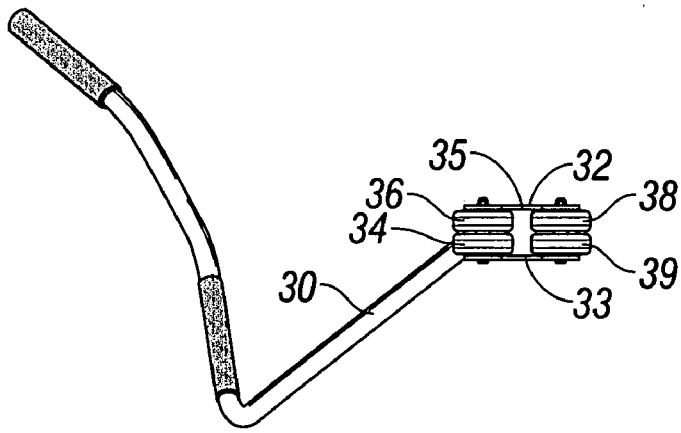
FIG. 4 is an elevated, pictorial, bottom view of the apparatus according to, but rotated 90° from the apparatus of FIG. 3.
Figure 5:
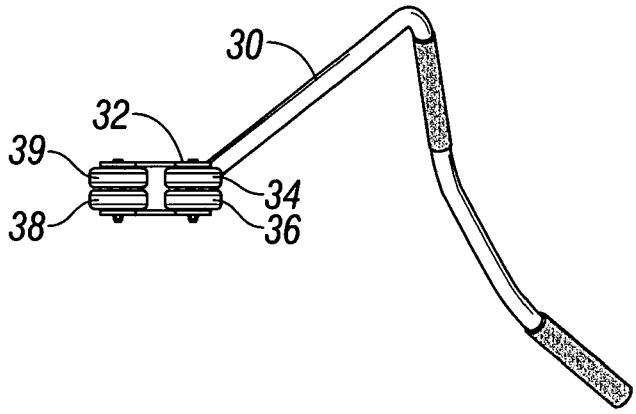
FIG. 5 is an elevated, pictorial, bottom view of the apparatus according to, but rotated 180° from the apparatus of FIG. 3.

Attached to the lower arm is a channel member 32 housing the rollers 34, 36, 38 and 39, illustrated in greater detail in FIGS. 3, 4, and 5.

Figure 2:
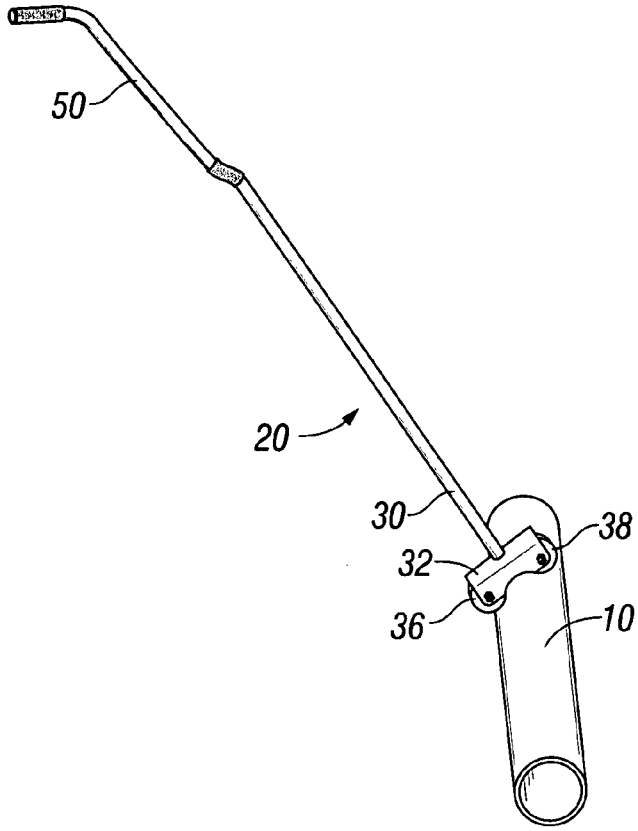
FIG. 2 is an elevated, pictorial, side view of the apparatus of FIG. 1 being used to roll a tubular.

Referring now to FIG. 2, the handle 20 and its channel 32 is illustrated as a side view of the embodiment of FIG. 1, illustrating the rollers 36 and 38 contacting the external surface of the tubular 10.

Referring now to FIG. 3, there is illustrated the channel member 32 which is connected to the lower end of the arm 30. Four rollers, 34, 36, 38, and 39 are mounted within the interior of channel member 32, with rollers 34 and 36 on a first common axle and rollers 38 and 39 on a second common axle.

It should be appreciated that the lower end of the first arm 30 is connected to the channel member 32 by any conventional means, such as by bolting, by welding, or any other conventional connection devices or methods. The referred embodiment of the invention illustrated in FIG. 3 pair of rollers on a common axle and a second pair of rollers on the second common axle. However, those skilled in art, will recognize that different numbers of rollers can be used within the channel number 32 if desired. For example, a first pair of rollers could be replaced with a single roller or with more than two rollers, depending upon the requirements of the job. For a further example, the rollers 34 and 36 could be replaced by a single roller, while leaving the pair of rollers 38 and 39 working with that single roller. Conversely, the pair of rollers 38 and 39 could be replaced by a single roller and work in conjunction with the pair of rollers 34 and 36.

The rollers 34, 36, 38 and 39 can be made from any material which can provide traction with the external surface of the pipe 10, but will typically be made from rubber or like materials well known in the arts involving roller wheels.

It should be appreciated that FIGS. 3, 4 and 5 are normally different views of the same device in accordance with the present invention. In FIG. 3, the bottom view of the channel 32 and the four rollers is illustrated as an elevated view. In FIG. 4, the channel 32 is rotated 90° from the illustrated in FIG. 3, to illustrate the channel 32 in a substantially horizontal position. FIG. 5 is a similar horizontal view of the channel 32, but with the channel 32 rotated 180° from the view illustrated in FIG. 3.

The channel 32 preferably has its two sidewalls having concave openings 33 and 35, respectively, which provide for better contact between the four wheels and the tubular 10 which is being rolled along.

Referring now to FIG. 6, there is illustrated a diagramatic view of the ergonomic handle 20 which is preferably used with this present invention. It should be appreciated that the handle 20 is fabricated from a single, continuous length of ¾ inch aluminum pipe which preferably is schedule 80, which before being formed, is 60 inches in length. The aluminum pipe which is used to make the handle 20 illustrated in FIG. 6 has a slight bend 31 immediately before the first arm 30 comes into play, then followed by a sharp bend 41 moving into the second arm 40. For convenience sake, the arm 30 and the short length of pipe between the bend 31 and the channel 32 is considered as one arm, i.e., the first arm 30. This is followed by a slight bend 51 immediately preceeding the third arm 50, followed by a slight bend 61 leading to the fourth arm 60. The arms 40 and 60 are provided with non-slip handgrips 32 and 62, respectively, to allow the user to use both hands and thus control the apparatus according to the invention and thereby to cause the tubular 10 to be rolled along. It should be appreciated that the bends in said handle 20 are easily accomplished with conventional cold-bend devices available from many commercial vendors.

To reiterate, the entire handle 20 which is used with the channel member 32 is formed from a continuous, straight length of aluminum tubing. As used in this application, the word "continuous" is used to describe the handle 20, even after the handle is formed into its various arms as illustrated in FIG. 6. It should be appreciated that although aluminum is the preferred metal for forming the handle 20 in accordance with the invention, other metals can be used instead of aluminum so long as they can be formed into the ergonomic configuration which is illustrated in FIGS. 1-6. Because the handle is formed from a continuous, straight length of aluminum tubing, the ergonomic handle according to the present invention, does not depend upon any external arms or handles in its operation.

In this preferred embodiment, the arms 40 and 60 are in two planes which are substantially parallel to each other. The arm 50 bears a preferred angle of about 45° between the two planes containing the arms 40 and 60. The arms 30 and 40 form an angle of about 90°.

In the operation of the apparatus illustrated and described herein, with respect to FIGS. 1-6, it should be appreciated that the user, sometimes referred to in this art as being the operator, will typically walk up to the pipe 10 to be moved such as is illustrated in FIG. 1 herein, and place the rollers located within the channel against the external surface of the pipe 10. By the user applying weight with his hand against the arm 40 and the arm 60, the rollers will be caused to rotate, thus causing the tubular 10, and the tubular 10 will be rolled along. Enabling the user to stand upright and push the pipe along at ground level, or on an elevated pipe rack, near the rig floor, allows the pipe to roll easily by pushing down on the apparatus illustrated in FIGS. 1-6. Thus, the pipe against which the weight is pushed starts rolling along to allow the separation of a single pipe from the rack and to start the pipe rolling process.

This present invention weighs approximately 4 pounds and can be quite easily handled by the user, whether in an oilfield operation or in an operation in which it is desired to roll other types of pipe.

The invention claimed is:

1. An apparatus for laterally rolling pipe from one position to another position, the apparatus comprising:

a roller housing having a plurality of roller wheels mounted in said housing;

an ergonomic handle formed from a continuous length of metal tubing, said handle having a first end and a first arm connected to said roller housing, a second arm located at a second end, and a third arm between said first and second ends, wherein the first arm, the second arm, and the third arm are angled relative to each other such that the ergonomic handle receives weight and force from a user and transfers the weight and force through the roller wheels to a pipe to be rolled, thereby laterally rolling the pipe as the roller wheels move along a surface of the pipe.

2. The apparatus according to claim 1, wherein said second arm, said third arm, or combinations thereof comprise at least one non-slip surface.

3. The apparatus according to claim 2, wherein said ergonomic handle comprises a substantially 90° bend between said first arm and said second arm.

4. The apparatus according to claim 2, wherein at least two of the arms occupy a single plane.

5. The apparatus according to claim 1, wherein said housing comprises first and second spaced apart axles, and wherein said plurality of roller wheels comprises two wheels mounted on said first axle, and two wheels mounted on said second axle.

6. A method for rolling a pipe, the method comprising the steps of:

pressing a plurality of roller wheels mounted in a roller housing with an ergonomic handle formed from a length of continuous metal tubing, against the external surface of a pipe, thereby causing the pipe to roll in a lateral direction, wherein the ergonomic handle comprises multiple members angled relative to each other such that the ergonomic handle receives weight and force from a user and transfers the weight and force through the roller wheels to a pipe to be rolled, thereby laterally rolling the pipe as the roller wheels move along a surface of the pipe; and ceasing to press the plurality of roller wheels against the external surface of the pipe once the pipe has been moved to the desired location.

7. The method according to claim 6, wherein said pipe is an oilfield tubular.

* * * * *